United States Patent [19]

Stefano

[11] 4,169,575

[45] Oct. 2, 1979

[54] DETACHABLE ANTENNA MOUNTING BRACKET FOR AUTOMOBILES

[75] Inventor: Patrick L. Stefano, Parma, Ohio

[73] Assignee: Hustler, Inc., Kissimmee, Fla.

[21] Appl. No.: 832,169

[22] Filed: Sep. 12, 1977

[51] Int. Cl.[2] ..... H01Q 1/32

[52] U.S. Cl. ..... 248/539; 248/226.2; 248/226.4; 343/713

[58] Field of Search ..... 24/263 A; 52/110; 248/225.3, 226.2, 226.4, 534, 539; 269/164, 249, 250, 251, 258; 343/713, 715, 880, 881, 882, 892, 711

[56] References Cited

U.S. PATENT DOCUMENTS

| | | | |
|---|---|---|---|
| 1,587,820 | 6/1926 | Carter | 269/249 X |
| 1,764,071 | 6/1930 | Foulke | 248/534 X |
| 2,450,994 | 10/1948 | Schaefer | 269/249 |
| 2,608,336 | 8/1952 | Dole | 24/263 A X |
| 2,894,283 | 7/1959 | Salisbury | 269/249 X |
| 3,071,338 | 1/1963 | Kaufman et al. | 248/539 |
| 3,493,203 | 2/1970 | Gualano | 248/539 |
| 3,555,551 | 1/1971 | Gronlund | 248/539 X |

*Primary Examiner*—Lawrence J. Staab

*Attorney, Agent, or Firm*—Meyer, Tilberry & Body

[57] ABSTRACT

A mounting for a radio antenna which enables the antenna to be easily mounted on and demounted from the edge of the trunk lid of an automobile without marring the surface. The mount consists of a flat base member and a clamping member pivoted relative to the base in the plane thereof and having a lip spaced from the base. A clamping pad is mounted on the base for movement toward and away from the lip by means of a screw threaded in the base. The members are pivoted so that the lip is exposed and may be easily inserted into the space between the edge of the trunk lid and the body of the automobile without interference from the base. The base is then pivoted relative to the clamping member so as to be opposite the lip and the clamping pad is pushed against the outside of the trunk lid.

5 Claims, 5 Drawing Figures

FIG. 1
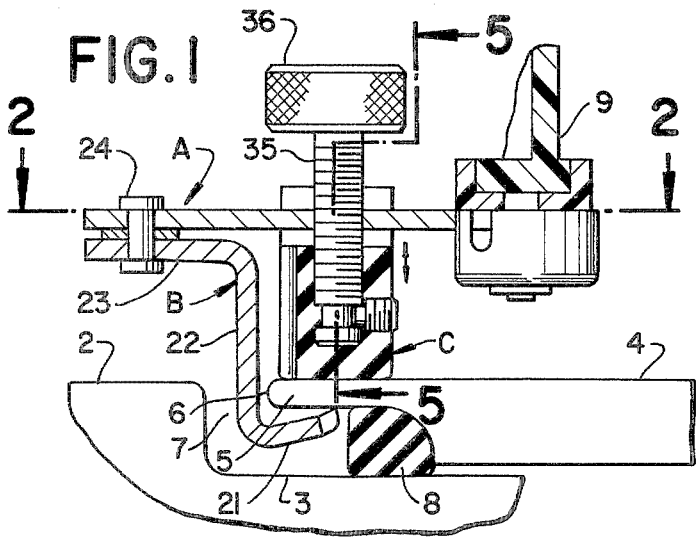
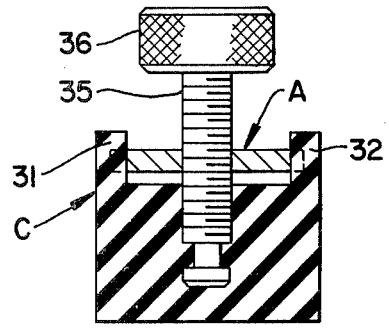
FIG. 5
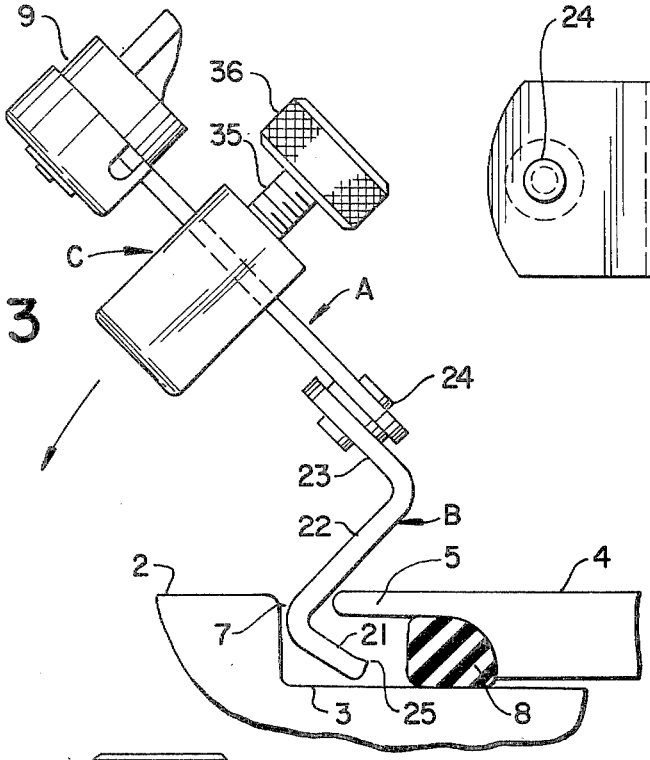
FIG. 3
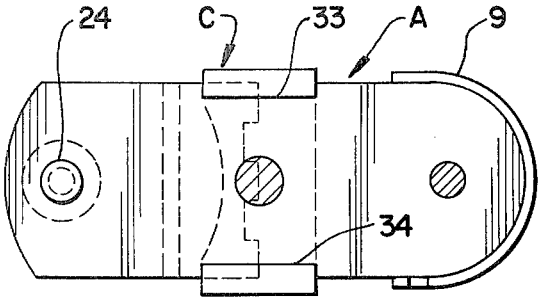
FIG. 2
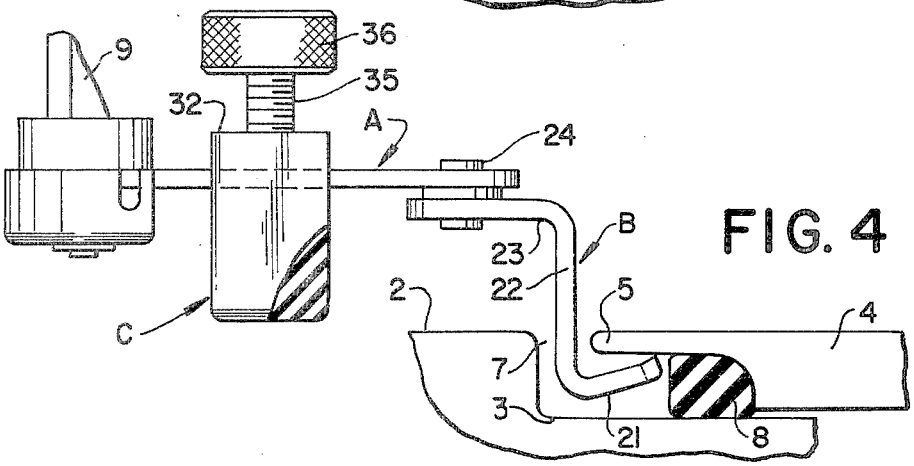
FIG. 4

DETACHABLE ANTENNA MOUNTING BRACKET FOR AUTOMOBILES

The present invention relates to the art of automobile radio antennas and more specifically to a device for detachably mounting a radio antenna to a thin edge of a part of an automobile such as a trunk lid.

In the art of mounting radio antennas on vehicles, it is often times desirable to be able to completely remove the antenna from such vehicle without leaving any trace of the existence of such antenna mounting so that the existence of radio equipment on the inside will not be apparent to strangers. Heretofore, this has not been possible. Either the antenna mount required holes to be drilled in the vehicle body or it was impossible to mount the antenna on the vehicle without first opening the trunk and then fastening the bracket to the edge thereof. Alternatively permanent magnets have been used. However, these have been known to release unexpectedly due to wind pressures on the antenna.

It will be appreciated that normally there is a small crack between the edge of the trunk lid and the body of the car and the present invention provides a mount which may be easily clamped and unclamped to this lip without opening of the trunk.

In accordance with the present invention, there is provided a mount for an antenna on the edge of the trunk lid of an automotive vehicle comprised of an outer bracket member, an inner bracket member having an offset lip normally in fixed parallel spaced opposed relationship to the outer member, and a clamping pad associated with the base of the antenna supported on the outer bracket member so as to be movable toward the outer surface of the trunk lid to draw the inner member lip against the inner surface of the trunk lid.

In the preferred embodiment, the inner and outer bracket members are movable to a non-opposed relationship whereby the inner bracket member lip, by appropriately manipulating the entire assembly, can be inserted through the crack between the edge of the lid and the body of the automotive vehicle into position adjacent the inner surface of the trunk lid.

In the preferred embodiment, the inner and outer bracket members are pivoted at one end about an axis through the plane of the bracket members whereby the inner bracket member may be rotated that the lip is in non-opposed parallel relationship with the outer bracket member. The clamping pad may have a pressure pad of soft non-marring material on the end facing the outer surface of the lid such that when the antenna mount is rotated in a direction to move the pad toward the trunk lid, the surface of the trunk lid will not be marred.

The inner bracket member lip preferably has means thereon for piercing any paint or other film on the inner surface of the lid whereby to affect a grounding action for the radio antenna.

The principal object of the invention is the provision of a new and improved mount for radio antennas on the trunk lids of automotive vehicles which enables the antenna to be quickly mounted and/or dismounted and which does not mar the external surface of the vehicle.

Another object of the invention is the provision of a new and improved mount for radio antennas which can be quickly mounted on and dismounted from the trunk lid of an automotive vehicle whereby rotating the base of the antenna, the mount may be clamped in position and will effect its own grounding action.

Another object of the invention is the provision of a new and improved mount for radio antennas on automotive vehicles which is attractive in appearance, relatively inexpensive to manufacture and simple and positive in operation and installation.

The invention may take physical form in certain parts and arrangements of parts preferred embodiments of which will be described in detail in this specification and illustrated in the accompanying drawings which form a part hereof and wherein:

FIG. 1 is a side view partly in cross section of an antenna mount installed on an automobile and illustrating a preferred embodiment of the invention;

FIG. 2 is a top plan view partly in section of the mount showing in dotted lines the installation position of the clamping member;

FIGS. 3 and 4 are views of the mount of FIG. 1 showing the first two installation steps on the lid of an automotive vehicle.

FIG. 5 is a partial cross section taken along line 5—5 of FIG. 1 showing a preferred embodiment of the clamping pad.

Referring now to the drawings wherein the showings are for the purposes of illustrating a preferred embodiment of the invention only and not for the purpose of limiting same, FIG. 1 shows a base member A, a clamping member B pivoted relative thereto and a clamping pad C associated with the base member A and adapted to press against the outside of the trunk lid of an automobile.

The automobile forms no part of the present invention and is shown for the purposes of illustration only. It includes a body 2 having a trunk opening surrounded by a rabbet 3. A trunk lid 4 closes the opening and has a relatively thin lip 5 defined by an edge 6 which is spaced from the body 2 by a gap 7 generally $\frac{1}{8}''$ to $\frac{1}{4}''$ wide. Foam weather strip 8 in the rabbet 3 seals the opening. The base member A is generally in the shape of a flat rectangular plate having an opening at one end in which the base of an antenna 9 can be supported in insulated fashion, all as is conventional.

The clamping member B generally includes an inner leg or lip 21, a vertical leg 22 and a second leg 23 which is generally parallel to leg 21 but extends from leg 22 in the opposite direction. Leg 23 has an opening therethrough aligned with a corresponding opening in one end of the base A and pivot means in the form of a rivet 24 extends through these aligned openings. Thus, the base and clamping members A and B are pivotally supported relative to each other about an axis perpendicular to the plane of the base member A and the clamping member B can be moved from a position where its leg or lip 21 is in spaced, opposed, parallel relationship with the base A to a position where it is in spaced non-opposed relationship to the base A. When in this latter position, the entire assembly may be tilted as is shown in FIG. 3 such that the leg or lip 21 can be inserted through the gap 7 and the entire assembly then rotated as is shown in FIG. 4 to where the leg 21 is abutting against the undersurface of the lip 5. At this point, the base member A can be pivoted relative to the clamping member B to where it is in spaced, opposed, parallel relationship with the leg or lip 21 of the clamping member B.

Means are provided for drawing the leg 21 into pressure engagement with the lower or inner surface of the lip 5. In the embodiment shown, such means include the clamping pad C which is in the form of a rectangular block of preferably nonmetallic material or of metallic material with a surface of nonmetallic soft material which is movable away from the lower surface of the base A towards the upper surface of the leg 21. In the embodiment shown, the block is provided with a pair of upwardly extending ears 31, 32 which are slidable in corresponding notches 33, 34 formed in the edges of the base plate A. A screw 35 is threadably supported in the base plate A midway between these upwardly extending ears and projects into an opening in the clamping pad and is fixed thereto in any suitable way so that the screw can be rotated and exert a pressure downwardly on the pad to press it against the outer surface of the lip 5. The screw is provided with a knurled knob 36 above the plate A so that the screw can be readily rotated by a simple manual operation to press the pad downwardly against the upper surface of the lip 5 which of course draws the clamping leg or lip upwardly against the inner or lower surface of the lip 5.

In the preferred embodiment, the leg 21 angles away from the leg 22 slightly upwardly and the upper end corners 25 of the leg 21 are bent upwardly slightly to provide a point which will pierce the paint of the lip 5 on the inner surface to provide a ground connection for the antenna mount.

To remove the mounting, it is simply necessary to rotate the screw until the clamping pad C is free of the outer surface of the lip 5 and then by appropriately rotating the base A relative to the clamping member B, the leg or lip 21 may then be withdrawn from the gap 7 of the vehicle and the entire antenna mount thus removed from the vehicle.

It will be appreciated that the antenna employed is what is normally known as a vertical antenna working against a ground plane which, in this instance, is the metal of the trunk lid. Obviously, if it is desired, the entire body of the automobile can function as a part of the ground plane by using grounding straps between the trunk lid and the body of the automobile. The provision of such grounding means forms no part of the present invention.

Normally, using the present invention, the coaxial cable used to energize the antenna will extend on the outside of the vehicle through a window to the transmitter and receiver on the inside. It is thus possible to remove the antenna and any external appearance of the presence of a transmitter receiver on the inside of the vehicle. It will be appreciated, however, that it is possible to have the coaxial cable extend through the gap 7 such that when the antenna is removed, the trunk may then be opened and the antenna stowed in the trunk completely out of sight.

The invention has been described as with reference to a preferred embodiment and in such detail that it is believed that anyone skilled in the art could readily make and use the invention. Obviously, modifications and alterations will occur to others upon a reading and understanding of this specification and it is my intention to include all such modifications and alterations insofar as they come within the scope of the appended claims.

Having thus described my invention, I claim:

1. A device for detachably mounting an antenna on the trunk lid of an automobile comprised of: a generally flat outer base member and an inner clamping member pivoted relative to said base member about an axis perpendicular to the plane of said base member, said clamping member having a clamping lip spaced from the plane of said base member and being movable from a first normal position where said lip is in spaced, opposed, generally parallel relationship to said base member to a second position wherein said lip is in spaced, non-opposed, relationship to said base member whereby said lip can be inserted into the space between the trunk lid of an automobile and the body thereof without interference from the base member and means threadably supported on said base member for engaging the outer surface of the trunk lid and drawing the lip against the inner surface of the trunk lid thereby clamping said device on said lid said means include a nonmetallic pad having a pair of spaced upstanding legs slidably received by a pair of notches in the edges of said base member and a shaft readily supported in said base member and engaging said pad.

2. A device for detachably mounting an antenna on the trunk lid or other lip of an automobile comprised of a generally flat base member and a rigid clamping member having a first leg pivotally supported relative to said base member on an axis perpendicular to the plane of said base member, a generally vertical downwardly extending leg and a third leg extending from the lower end of the said vertical leg from the side opposite said first leg and generally at a slight angle upwardly towards the lower surface of said base member, said clamping member being pivoted from a first normal position wherein said third leg is in spaced, nonopposed relationship to the undersurface of said base member whereby said third leg can be inserted into the space between the trunk lid of an automobile and the body thereof without interference from said base member to a second position where said third leg is in spaced, opposed, generally parallel relationship with the undersurface of said base member and means threadably supported on the base member for engaging the outer surface of the trunk lid and drawing the third leg upwardly against the inner surface of the trunk lid whereby said device can be rigidly clamped in position on said trunk lid.

3. The device of claim 2 wherein said means include a nonmetallic clamping pad and a threaded shaft readily supported in the base member and engaging said pad.

4. The device of claim 3 wherein said pad has a pair of upwardly extending legs slidably engaged with the edges of said base member.

5. The combination of the device of claim 4 wherein the edges of said base member have notches therein for slidably receiving said legs.

* * * * *